US005755119A

United States Patent [19]

Scatizzi

[11] Patent Number: 5,755,119

[45] Date of Patent: May 26, 1998

[54] APPARATUS FOR DYEING TEXTILE MATERIALS

[75] Inventor: Mario Scatizzi, Pistoia, Italy

[73] Assignee: Tecnorama S.R.L., Prato, Italy

[21] Appl. No.: 713,182

[22] Filed: Sep. 12, 1996

[30] Foreign Application Priority Data

Sep. 22, 1995 [IT] Italy ..... FI95A0199

[51] Int. Cl.[6] ..... D06B 5/22

[52] U.S. Cl. ..... 68/15; 68/156; 68/170; 68/196; 68/207

[58] Field of Search ..... 68/15, 148, 150, 68/151, 156, 165, 170, 196, 207

[56] References Cited

U.S. PATENT DOCUMENTS 1,393,641 10/1921 Richardson ..... 68/156 X
2,737,571 3/1956 Eisler ..... 68/15 X
3,417,414 12/1968 Claiborne ..... 68/207 X
3,429,149 2/1969 Ellner ..... 68/156 X

*Primary Examiner*—Philip R. Coe
*Attorney, Agent, or Firm*—McGlew and Tuttle

[57] ABSTRACT

Apparatus for dyeing textile materials with a fixed, hollow and substantially cylindrical body intended to contain a dyeing bath consisting of water and dyeing substances in predetermined proportions, comprising in combination:—a basket for holding the materials to be dyed, whose side wall is provided with a plurality of ports or openings for the communication of the basket with the cavity of the body, and with upper and lower bases being provided with corresponding ports or openings, the basket being locatable within the cavity of the container and a transmission driven by a corresponding driving member and connected to the upper base of the basket for the vertical reciprocating movement thereof.

17 Claims, 3 Drawing Sheets

APPARATUS FOR DYEING TEXTILE MATERIALS

FIELD OF THE INVENTION

The present invention refers to an apparatus for dyeing textile materials.

BACKGROUND OF THE INVENTION

In the dyeing of textile materials it is known that the fibers of the materials must be subjected to the action of suitable dyes diluted in a dyeing bath, for a time and at a temperature preset according to the nature of the fibers and the type of dyes being used.

SUMMARY AND OBJECTS OF THE INVENTION

The main object of the present invention is to provide an apparatus allowing to perform the dyeing of the textile materials in a manner which is simpler, more economical and reliable than the traditional dyeing techniques.

According to the invention, an apparatus is for dying textile materials is provided with a fixed, hollowed and substantially cylindrical body. The cylindrical body is intended to contain a dying bath consisting of water and dying substances in predetermined proportions. The apparatus includes a basket for holding the materials to be dyed which has side walls provided with a plurality of ports or openings for the communication of the basket with the cavity of the body. The upper and lower bases are provided with corresponding ports or openings. The basket is locatable within the cavity of the container. A transmission is provided driven by a corresponding driving member and connected to the upper base of the basket. The transmission provides vertical reciprocating movement of the basket.

The advantages deriving from the present invention lie essentially in that it is possible to achieve a proper and efficient dyeing of the textile materials with a reduced consumption of water, dyes and electrical power; that an apparatus according to the invention is simple to make, cost-effective and reliable even after a prolonged service life. These and other advantages and characteristics of the invention will be best understood by anyone skilled in the art from a reading of the following description in conjunction with the attached drawings given as a practical exemplification of the invention, but not to be considered in a limitative sense in the drawings.

DETAILED DESCRIPTION OF THE PREFERRED EMBODIMENT

Figure 1:
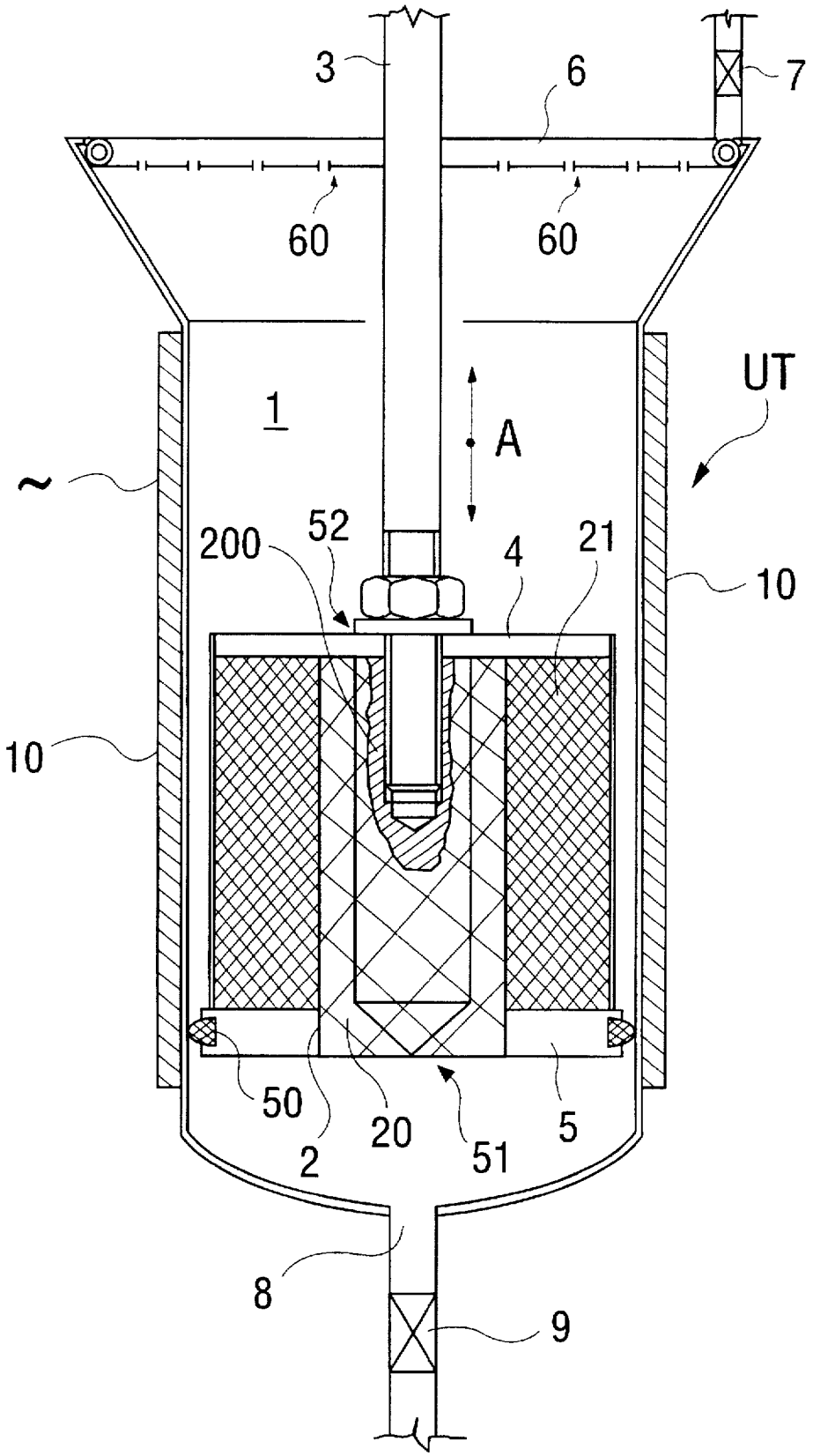
FIG. 1 shows schematically the view in longitudinal section of an apparatus according to the invention under operating condition.

Reduced to its basic structure, and reference being made to the figures of the attached drawings, an apparatus for dyeing textile materials according to the invention comprises, in combination:

- a fixed, hollow and substantially cylindrical body (1) intended to contain a dyeing bath consisting of water and dyeing substances in predetermined proportions

- a basket (2) for holding the materials to be dyed, whose side wall is provided with a plurality of ports or openings (20) for the communication of the basket (2) with the cavity of said body (1), and with the upper (4) and lower (5) bases or upper support portion 4 and lower support portion 5 being provided with corresponding ports or openings (52, 51): said basket (2) being locatable within the cavity of the container (1);
- a transmission (3) driven by a corresponding driving member (30) and connected to the upper base (4) of said basket (2) for the vertical reciprocating movement thereof.

Advantageously, according to the invention, the side wall of said basket (2) is formed by a net whose meshes make up ports or openings (20) for the communication of the basket (2) with the cavity of the cylinder (1).

A mesh (21) with narrow meshes is advantageously mounted coaxially to said basket (2) so as to form a protection preventing the textile material from coming out of the basket (2).

Advantageously, in axial alignment with the basket (2), a substantially cylindrical body (200) is provided which is intended to delimit, in cooperation with the inner wall of the basket (2), an annular chamber for housing the materials to be treated.

Again, advantageously, the lower base (5) of said basket (2) is provided with an annular gasket (50) to allow for a tight seal contact thereof with the inner wall of the container (1).

It is further advantageously provided that said transmission (3) be made up of a stiff rod with vertical axis, with its lower end being solid to the basket (2) and the upper end engaged to said driving member (30). Said member (30) being possibly, for example, a pneumatic piston or a linear actuator with electrical motorization.

Located in correspondence of the upper base or upper portion of said container (1) is an annular duct (6) engaged with a solenoid valve (7) and provided with a plurality of nozzles (60), for the admission of water to cool the dyeing bath and wash the container (1).

Located in correspondence of the lower base of the container (1) is a port (8) with a solenoid valve (9) for evacuating the dyeing bath out of the container (1).

Means are also provided for heating the dyeing bath, with an electrical resistor (10) in thermal contact with the outer wall of said container (1), the latter being suitably made of heat conducting material.

Said dyeing unit (TU) is mounted on a corresponding fixed support (11).

Figure 2:
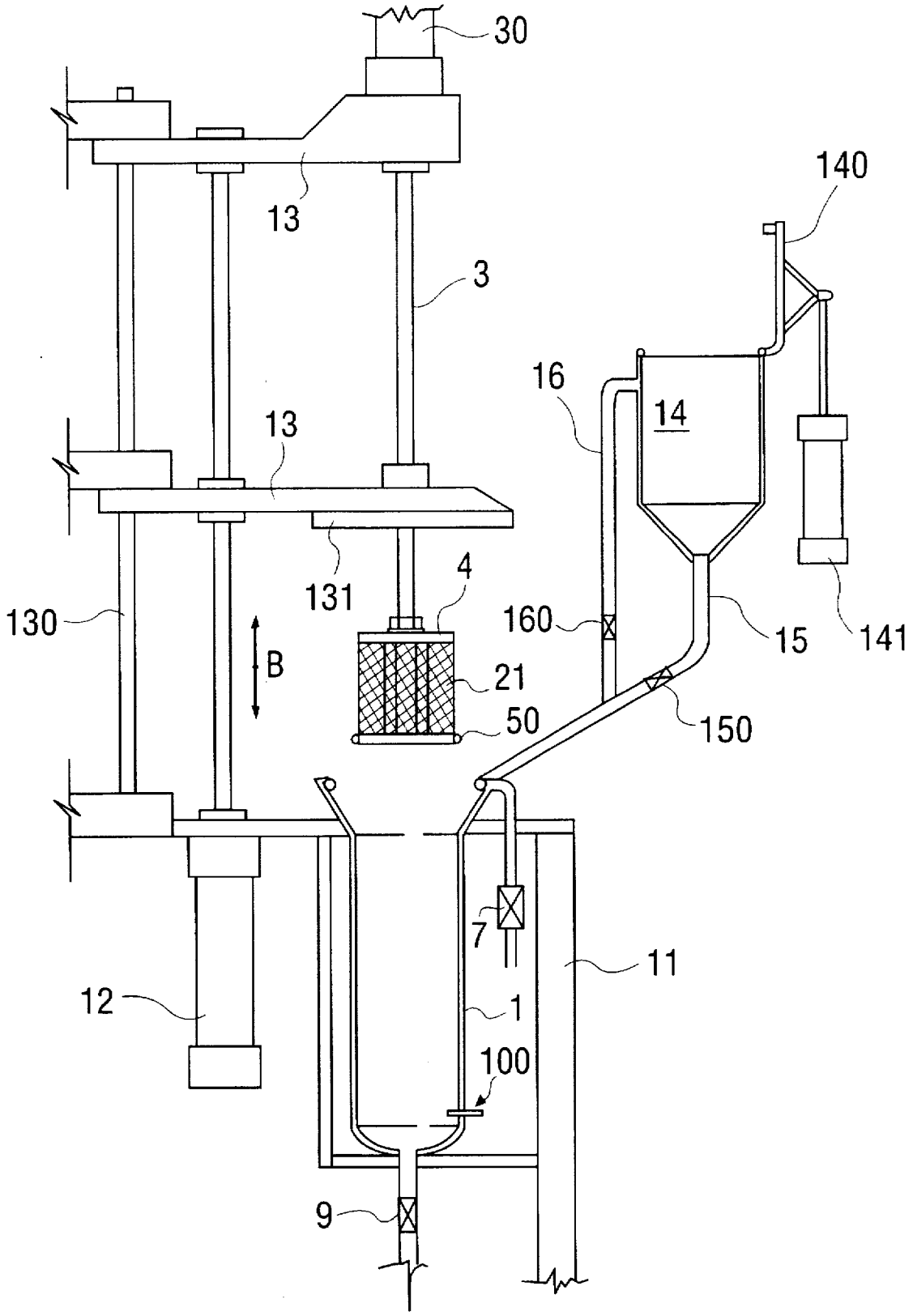
FIG. 2 shows schematically an apparatus according to the invention with the basket being withdrawn from the dyeing bath.
Figure 3:
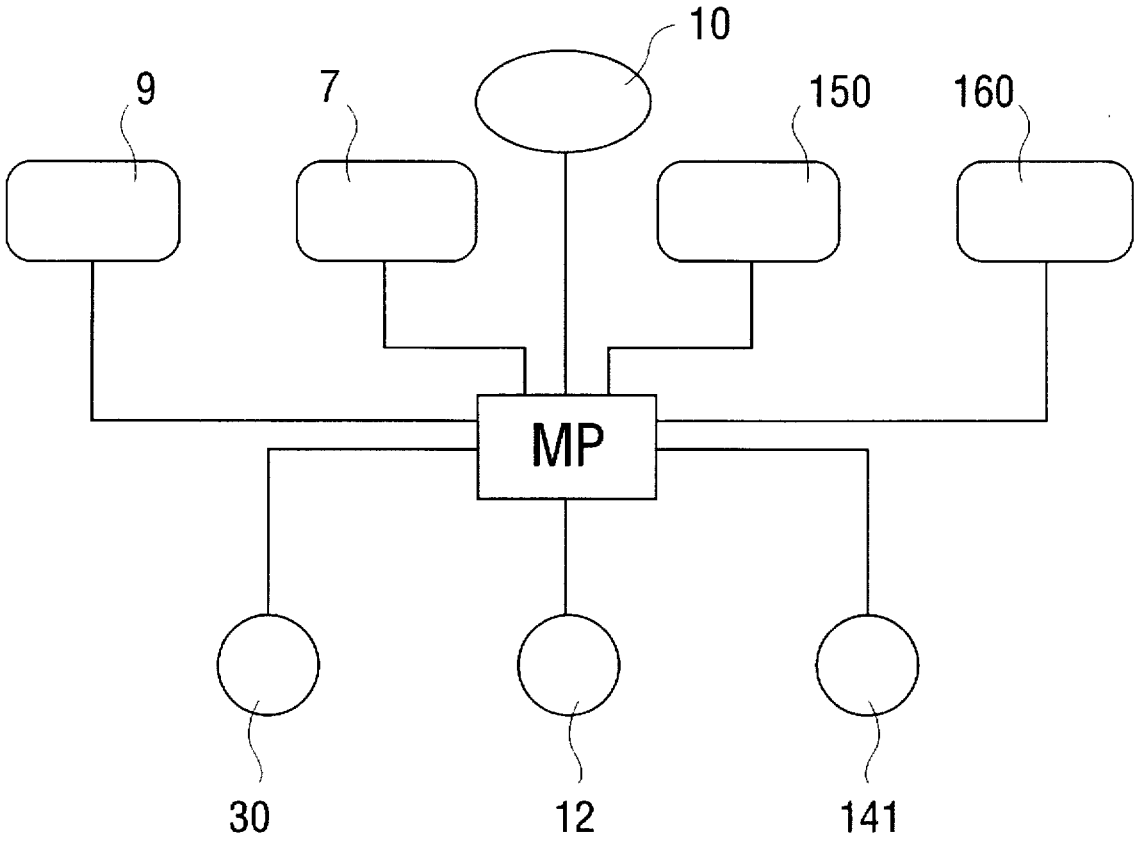
FIG. 3 shows a simplified block diagram of the member for driving the apparatus of FIGS. 1 and 2.

The positioning of said basket (2) outside and inside the container (1) is attainable by means of a cylinder actuator (12) whose stem operates a support (13), provided with straight vertical guides (130), of the transmission rod (3): the member (30) for driving the rod (3) being mounted on the same support (13). An element (131) of the support (13), located on top of the basket (2), is so shaped as to act as a body for the closing/opening of the mouth of the container (1). By lowering, respectively, lifting said support (13) by means of the cylinder (12), there is obtained the positioning of the basket (2) inside, respectively, outside the container (1), and the closing, respectively, opening of the latter (see arrows B in FIG. 2).

Advantageously, provision is also made for a dye-supplying vessel (14): the latter being connected to the container (1) via a duct (15) with an equipressure branch (16).

The above said vessel (14) is advantageously provided with a lid (140) operable by a corresponding actuator member (141) and with traditional washing means, not shown in the figures of the attached drawings for the sake of clarity.

Advantageously, according to the invention, programmable electronic means (MP) are provided to drive and control said member (30) , as well as all the above mentioned solenoid valves and said heating means (10), according to a preset program suitably stored in a memory unit of the same means (MP). The technical characteristics of such electronic means, being known per se by those skilled in the art of industrial automation, will not be described herein in detail.

Said container (1) is advantageously provided with a thermal sensor (100) for measuring the temperature inside the dyeing bath.

The operation of the above described apparatus is as follows.

After having predisposed the dyeing bath in the container (1)—the dyeing bath being obtained by mixing water and suitable dyeing substances together according to a conventional technique—and having introduced the textile materials into the basket (2), the latter is introduced into the container (1) and repeatedly lifted and lowered by means of the motorized transmission (3) (see arrows A in FIG. 1). Upon the step for the lowering of the basket (2), the dyeing liquid inside the container (1) is forced, by virtue of said lowering, to transit through said port (51) of the basket (2) so as to enter the latter and then come out therefrom through the meshes (20) to flow towards the upper part of the container (1), after having fully and energetically crossed the fibers of the materials disposed inside the same basket (2). During this step, the liquid exerts a mechanical action of centrifugal expansion onto the same fibers. Upon the step for the lifting of the basket (2), the dyeing liquid is forced to flow from the upper to the lower part of the container (1) by following a route opposite to the previous one, that is, it enters the basket (2) through the upper port (52) and, then, after having crossed again the fibers of the materials disposed inside the basket (2), comes out therefrom through the respective meshes (20).

During this step, the material inside the basket (2) is subjected to the action of centripetal thrust exerted by the fluid and tends to shrink in the direction of the axis of the basket (2). All this makes it possible to obtain a regular and uniform dyeing action on the thus treated textile fibers. The number of handling cycles of the basket (2) is suitably chosen according to the characteristics of the materials to be treated and the dyeing bath. The introduction of further dye into the bath of the dyeing unit (UT) during operation, that is, with the basket (2) already positioned inside the container (1), can be performed by closing the lid (140) of the vessel (14), by actuating the opening of the solenoid valve (160) of duct (16) so as to induce an equipressure effect between the containers (1) and (14) and, afterwards, by actuating the opening of the solenoid valve (150) to allow the flow of the dye from the vessel (14) to the container (1).

An apparatus as above described can be advantageously associated to other devices of the same type to make up a machine or a system comprising more dyeing units (UT).

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

I claim:

1. An apparatus for dyeing textile materials, comprising:

a fixed, hollow and substantially cylindrical container defining a cavity for containing a dyeing bath consisting of water and dyeing substances in predetermined proportions;

a basket for holding the materials to be dyed, said basket including a side wall provided with a plurality of openings for the communication between an interior of said basket with an interior of said cavity, said basket having an upper base and a lower base, each of said upper base and said lower base having openings, said basket being locatable within said cavity;

a net with narrow meshes, said net being mounted coaxially to said basket so as to form a protective element preventing the textile material from coming out of the basket; and a transmission driven by a corresponding driving member and connected to said upper base for the vertical reciprocating movement thereof.

2. An apparatus for dyeing textile materials, comprising:

a fixed, hollow and substantially cylindrical container defining a cavity for containing a dyeing bath consisting of water and dyeing substances in predetermined proportions, said container having an upper portion;

a basket for holding the materials to be dyed, said basket including a side wall provided with a plurality of openings for the communication between an interior of said basket with an interior of said cavity, said basket having an upper base and a lower base, each of said upper base and said lower base having openings, said basket being locatable within said cavity;

a transmission driven by a corresponding driving member and connected to said upper base for the vertical reciprocating movement thereof; and an annular duct for the admission of water to cool the dyeing bath and wash said container, said annular duct being connected with a solenoid valve and provided with a plurality of nozzles, said annular duct being disposed adjacent to said upper portion of said container.

3. An apparatus for dyeing textile materials, comprising:

a fixed, hollow and substantially cylindrical container defining a cavity for containing a dyeing bath consisting of water and dyeing substances in predetermined proportions;

a basket for holding the materials to be dyed, said basket including a side wall provided with a plurality of openings for the communication between an interior of said basket with an interior of said cavity, said basket having an upper support portion and a lower support portion, each of said upper support portion and said lower support portion having openings, said basket being locatable within said cavity;

a transmission driven by a corresponding driving member, said transmission being connected to said upper support portion, and extending upwardly from said upper support portion for the vertical reciprocating movement of said basket.

4. The apparatus according to claim 3, wherein said side wall of said basket is formed by a net with a mesh defining said openings.

5. The apparatus according to claim 3, further comprising a net with a mesh, said net being mounted coaxially to said basket so as to form a protection element preventing textile material from coming out of said basket.

6. The apparatus according to claim 3, further comprising a substantially cylindrical body which is in axial alignment with said basket and cooperate with said wall of said basket to define an annular chamber for housing the materials to be treated.

7. The apparatus according to claim 3, wherein the lower support portion of said basket is provided with an annular gasket to allow for a tight seal contact thereof with the inner wall of the container.

8. The apparatus according to claim 3, wherein said transmission includes a stiff rod with a vertical axis and with a lower end fixed to said basket and having an upper end engaged with said driving member.

9. The apparatus according to claim 3, wherein said driving member is a pneumatic cylinder.

10. The apparatus according to claim 3, wherein said member is a linear actuator with electrical motorization.

11. The apparatus according to claim 3, further comprising: an annular duct for the admission of water to cool the dyeing bath and wash said container, said annular duct being connected with a solenoid valve and provided with a plurality of nozzles, said annular duct being disposed adjacent to an upper portion of said container.

12. The apparatus according to claim 3, further comprising: a port with a solenoid valve for evacuating the dyeing-bath from the container, said port being provided adjacent to a lower portion of said container.

13. The apparatus according to claim 3, further comprising means for heating the dyeing bath, with an electrical resistor in thermal contact with an outer wall of said container.

14. The apparatus according to claim 3, further comprising positioning means for positioning said basket outside and inside said container, said positioning means including a cylinder actuator whose stem operates a support, provided with straight vertical guides, of the transmission rod, said driving member for driving the rod being mounted on said support.

15. The apparatus according to claim 3 wherein an element of the support, located on top of the basket, is so shaped as to act as a body for the closing/opening of the mouth of the container.

16. The apparatus according to claim 3, further comprising a vessel for supplying the dye, said vessel being connected to the container via a duct with an equipressure branch.

17. The apparatus according to claim 3, wherein said transmission contacts said upper support portion and does not contact said lower support portion and extends only on an upper side of said basket.

* * * * *